US007445475B2

(12) United States Patent
Tajiri et al.

(10) Patent No.: US 7,445,475 B2
(45) Date of Patent: Nov. 4, 2008

(54) LEVER TYPE CONNECTOR

(75) Inventors: Yoji Tajiri, Inukami-gun (JP); Toshihiro Yoshida, Inukami-gun (JP); Yasuharu Suruga, Inukami-gun (JP); Katsunori Takeda, Inukami-gun (JP); Takeshi Watanabe, Inukami-gun (JP); Hiroshi Kobayashi, Okazaki (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 11/874,503

(22) Filed: Oct. 18, 2007

(65) Prior Publication Data

US 2008/0096397 A1 Apr. 24, 2008

(30) Foreign Application Priority Data

Oct. 19, 2006 (JP) ..... 2006-285456

(51) Int. Cl.
*H01R 13/62* (2006.01)

(52) U.S. Cl. ..... 439/157

(58) Field of Classification Search ..... 439/157, 439/160, 152, 310, 372
See application file for complete search history.

(56) References Cited

U.S. PATENT DOCUMENTS 5,110,301 A * 5/1992 Inoue et al. ..... 439/310
5,722,843 A * 3/1998 Kerckhof et al. ..... 439/157
5,833,484 A * 11/1998 Post et al. ..... 439/352
6,099,330 A * 8/2000 Gundermann et al. ..... 439/157
6,354,164 B1 * 3/2002 Megason et al. ..... 74/109
6,390,837 B1 * 5/2002 Lee ..... 439/160
6,540,532 B1 * 4/2003 Martin et al. ..... 439/157
6,558,176 B1 * 5/2003 Martin et al. ..... 439/157
6,644,991 B2 * 11/2003 Martin ..... 439/157

(Continued)

FOREIGN PATENT DOCUMENTS

JP 2002-117932 4/2002

(Continued)

OTHER PUBLICATIONS

U.S. Appl. No. 11/874,567, filed Oct. 18, 2007, Tajiri et al.

(Continued)

*Primary Examiner*—Alexander Gilman
(74) *Attorney, Agent, or Firm*—Oblon, Spivak, McClelland, Maier & Neustadt, P.C.

(57) ABSTRACT

A lever connector is provided where fitting of a connector holder is reliably performed by rotation of a lever, so that workability is excellent. In a connector holder 2, a provisionally-retaining claw 17 is provided to be elastically held by a first retaining portion 14 at a predetermined rotating position in order to restrict rotation of the lever 5. In a receptacle connector 3, a pressing projection 23 is provided to move the provisionally-retaining claw 17 to a retracted position where the provisionally-retaining claw 17 is not held by the lever 5 in a state that the connector holder 2 is at a standby position, so that restriction of rotation of the lever 5 is cancelled. On the other hand, an abutting surface of the first retaining position 14 of the lever 5 is of a mountain-like shape including a restricting surface 19 and a guiding surface 20.

15 Claims, 5 Drawing Sheets

U.S. PATENT DOCUMENTS

| | | | | |
|---|---|---|---|---|
| 6,854,992 | B2 * | 2/2005 | Martin et al. | 439/157 |
| 7,027,309 | B2 * | 4/2006 | Franz et al. | 361/798 |
| 7,384,286 | B2 * | 6/2008 | Imai et al. | 439/157 |
| 2001/0046797 | A1 * | 11/2001 | Sasaki et al. | 439/157 |

FOREIGN PATENT DOCUMENTS

| | | |
|---|---|---|
| JP | 2006-4894 | 1/2006 |
| JP | 2006-114429 | 4/2006 |
| JP | 2007-66816 | 3/2007 |

OTHER PUBLICATIONS

U.S. Appl. No. 11/874,503, filed Oct. 18, 2007, Tajiri et al.

* cited by examiner

LEVER TYPE CONNECTOR

This application claims the benefit of Japanese Patent Application Number 2006-285456 filed on Oct. 19, 2006, the entirety of which is incorporated by reference.

BACKGROUND OF THE INVENTION

1. Field of the Invention

The present invention relates to a lever type connector used for a branching connection of a wire harness disposed in an automobile, for example.

2. Description of the Related Art

A conventional lever type connector includes a connector holder capable of holding a plurality of connectors, and a receptacle connector which the connector holder is fit into and is able to hold a connector corresponding to a connector of the connector holder. The connector holder has a lever which is rotatable in the upper and lower directions.

In this lever type connector, when the lever is rotated after the connector holder is set at a standby position with respect to the receptacle connector, a fulcrum retaining portion provided with the lever is held by a retained portion provided with the receptacle connector. Consequently, the connector holder is biased to the fitting side of the receptacle connector by the principle of leverage, so that the connector holder is coupled to the receptacle connector with low fitting power.

In such lever type connectors, the lever is disposed at the center of the connector holder in the widthwise direction, and the connector can be held on both sides of the lever for the purpose of downsizing, as disclosed in Japanese publication of unexamined patent application No. 2006-4894. In this connector, such a configuration is adopted that the lever is held at a provisionally-retaining position when the lever is operated to rotate, in order to prevent the lever from being rotated accidentally before the connector holder and the receptacle holder are coupled to each other. This retaining configuration is constituted by a provisionally-retaining hole on a side surface of the lever. Through the hole a provisionally-retaining pin provided on a mounting surface of the lever of the connector holder penetrates. The lever is held by fitting the provisionally-retaining pin into the provisionally-retaining hole, and a lever retaining claw (a provisionally-retaining portion) provided on the connector holder is held by a corresponding edge of the lever, thereby retaining the lever provisionally. On the other hand, at the receptacle connector, a provisionally-retaining cancellation portion (a cancellation portion) is provided in order to allow the lever to be rotated at a standby position. The provisionally-retaining cancellation portion allows the lever retaining claw to be deformed to a retracted position where the retaining claw is not held by the lever at the standby position of the connector holder, so that restriction of the rotation of the lever is cancelled.

During assembling of this kind of lever type connector, there is a case that the lever is rotated in a state that the connector holder is not completely inserted into a standby position with respect to the receptacle connector. In this case, the lever is rotated before the lever retaining claw is fully deformed by the provisionally-retaining cancellation portion. As a result, the lever is held by the lever retaining claw and cannot be rotated. Thus, an operator is required to rotate the lever again after he confirms that the connector holder is pressed to a standby position where the retaining state is completely cancelled to rotate the lever, which causes loss of operation.

In view of the above, an object of the present invention is to provide a lever type connector where fitting of a connector holder is reliably performed by rotation of a lever even when the connector holder is incompletely inserted into a receptacle holder, so that excellent workability is obtained.

SUMMARY OF THE INVENTION

In order to achieve the above object, the invention according to a first aspect is characterized in that, an abutting surface of the lever of the connector holder to abut to the provisionally-retaining portion is formed to be a mountain-like shape including a restricting surface and a guiding surface. The restricting surface is held by the provisionally-retaining portion to restrict rotation of the lever, and the guiding surface is adjacent to the restricting surface to forcibly move the provisionally-retaining portion to a retracted position in accordance with rotation of the lever.

The invention according to a second aspect is characterized in that, in addition to an object of the first aspect, a pair of connector holders and a pair of receptacle connectors having corresponding receiving portions are provided. Each connector holder has a groove defined in the vertical direction on an outer surface thereof, and each receiving portion has a rib projecting on an inner surface thereof so as to be fit in the groove. Each pair of groove and rib is provided on the opposite side so that the connector holders and the receiving portions correspond one-to-one with each other. Moreover, the abutting surface of the lever of each connector holder has a symmetrical mountain-like shape in order to use a metallic mold for the lever in common, which is more advantageous in terms of cost.

According to the first aspect, when the connector holder is inserted into the receptacle connector, the provisionally-retaining portion is moved forcibly to a retracted position because of the guiding surface of the lever even when the lever is rotated in a state where the connector holder is not reached the standby position. Thus, provisionally-retaining of the lever is cancelled. Consequently, fitting by rotation of the lever is reliably performed, which provides excellent workability.

According to the second aspect, in a configuration where a pair of connector holders is disposed in the receptacle connectors on the opposite side to prevent incorrect fitting, the abutting surface of the lever has a symmetrical mountain-like shape. Therefore, in addition to an effect of the first aspect, the lever of only one type is sufficient even when it is necessary to prepare two types of connector holder, and a metallic mold for the lever can be used for both types of connector. This is advantageous in terms of cost.

BRIEF DESCRIPTION OF THE DRAWINGS

FIG. 3A is a provisionally-retaining position of the lever, and FIG. 3B is a fitting position.

FIG. 4A is an initial inserting position, and FIG. 4B is a pushdown position.

FIG. 5A is the standby position, and FIG. 5B is a fitting position.

DESCRIPTION OF THE PREFERRED EMBODIMENT

Hereinafter, an embodiment according to the present invention will be described with reference to the drawings.

Figure 1:
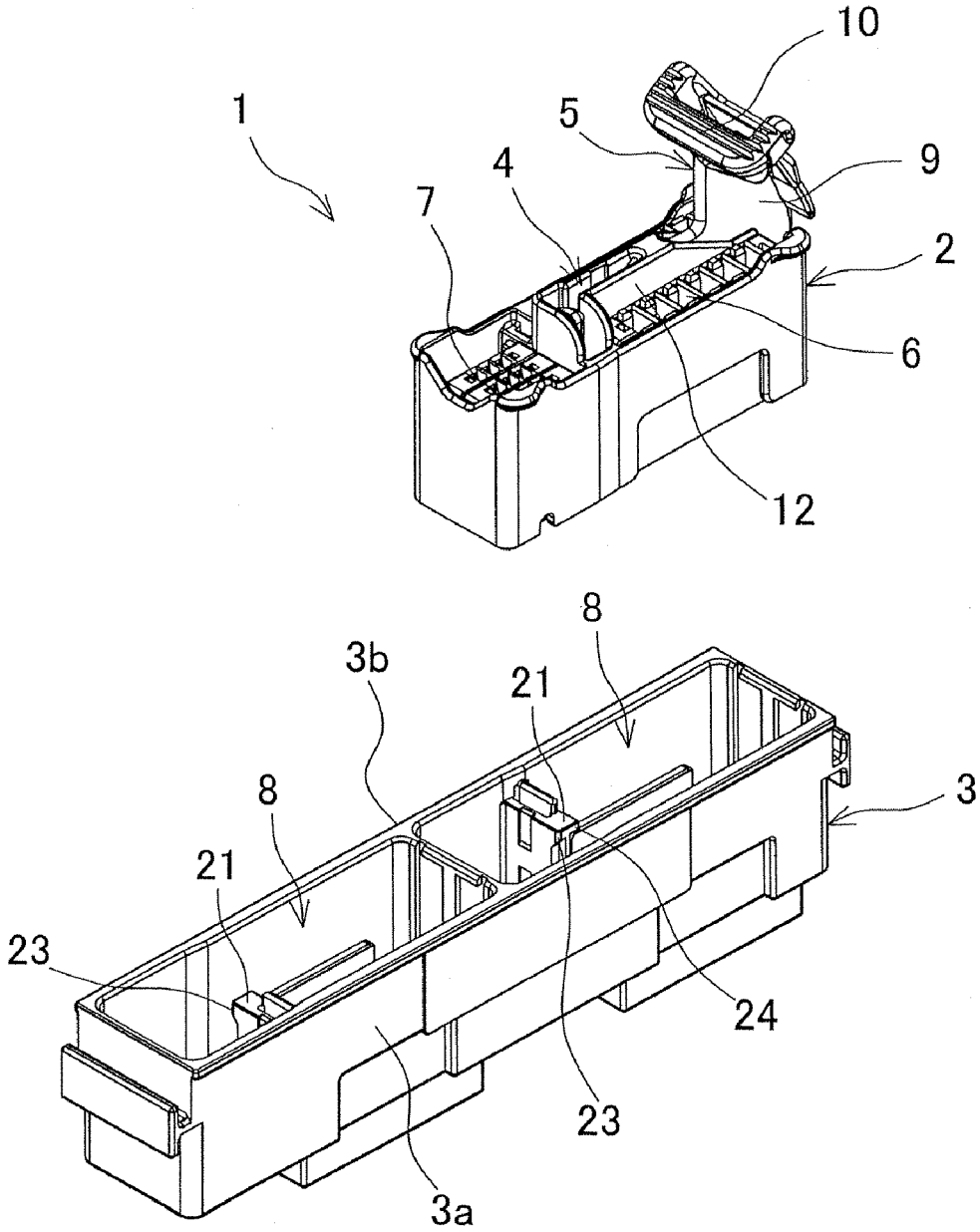
FIG. 1 is a perspective view of a lever type connector.

FIG. 1 is a perspective view of a lever type connector as an example. A lever type connector 1 includes a connector holder 2 and a receptacle connector 3 into which a pair of connector holder 2 is inserted and fit. In FIG. 1, one connector holder is omitted.

Figure 2:
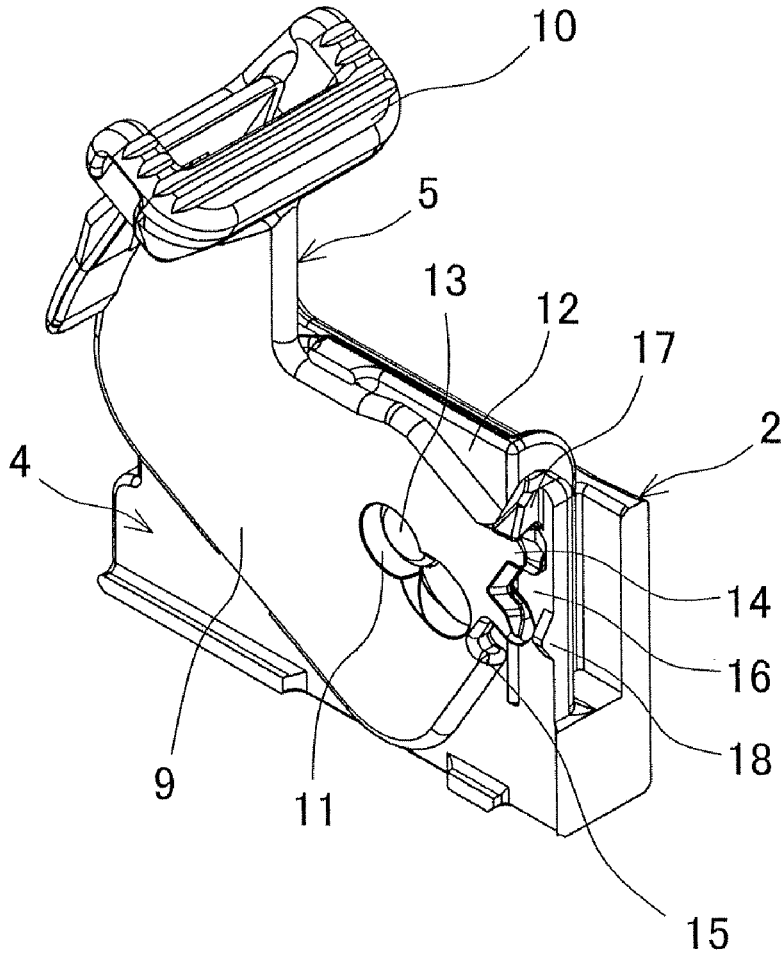
FIG. 2 is a partial perspective view of a connector holder.

The connector holder 2 is elongate box shaped and made of synthetic resin. As shown in FIG. 2, a lever 5 is disposed in a receiving groove 4 defined at the center in the widthwise direction. Female connectors 6, 6, in which a plurality of terminal insertion portions are linearly aligned, are able to be incorporated on both sides of the receiving groove 4. Moreover, a layered connector 7 in which a plurality of terminal insertion portions is arranged in a lattice shape are disposed on the front side of the lever 5 (that is, lower left side of FIG. 1). The pair of the connector holders 2, 2 is arranged in the same direction and inserted into a receiving portion 8, 8 of the receptacle connector 3. Each terminal insertion portion receives and secures an electric terminal mounted at a distal end of an electric wire.

As shown in FIG. 2, the lever 5 includes a lever main body 9 which is a plate-like body and L-shaped viewed from the side, and an operating portion 10 extendedly and orthogonally provided on an upper end of the lever main body 9. A hole 11 is formed through the lever main body 9 near the front edge thereof, and a circular projection 13 protruding from a wall surface of a partition 12 forming the receiving groove 4 is coupled to the hole 11, so that the lever 5 can pivot in an upper and lower directions around the circular projection 13. Moreover, on the front edge portion of the lever 5, which is ahead of the circular projection 13, a first retaining portion 14 on the upper side and a second retaining portion 15 on the lower side are provided. The first retaining portion is for provisionally-retaining, and the second retaining portion 15 serves as a fulcrum retaining portion when the lever 5 is fit into the receptacle connector 3.

Figure 3A:
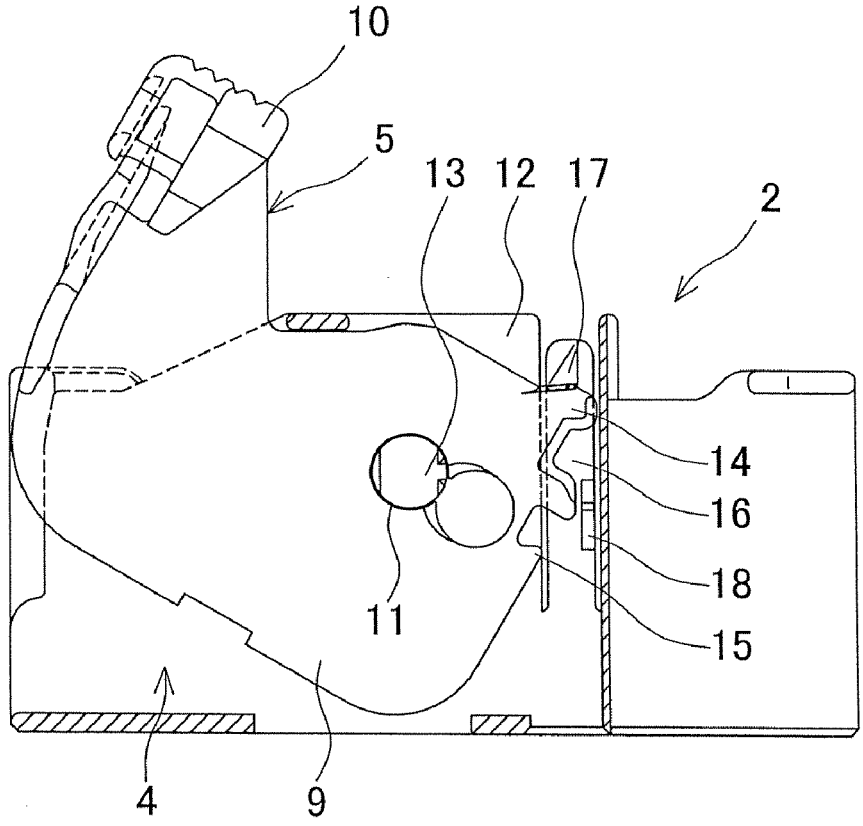
FIGS. 3A and 3B are vertical cross sectional views of the connector holder.
Figure 3B:
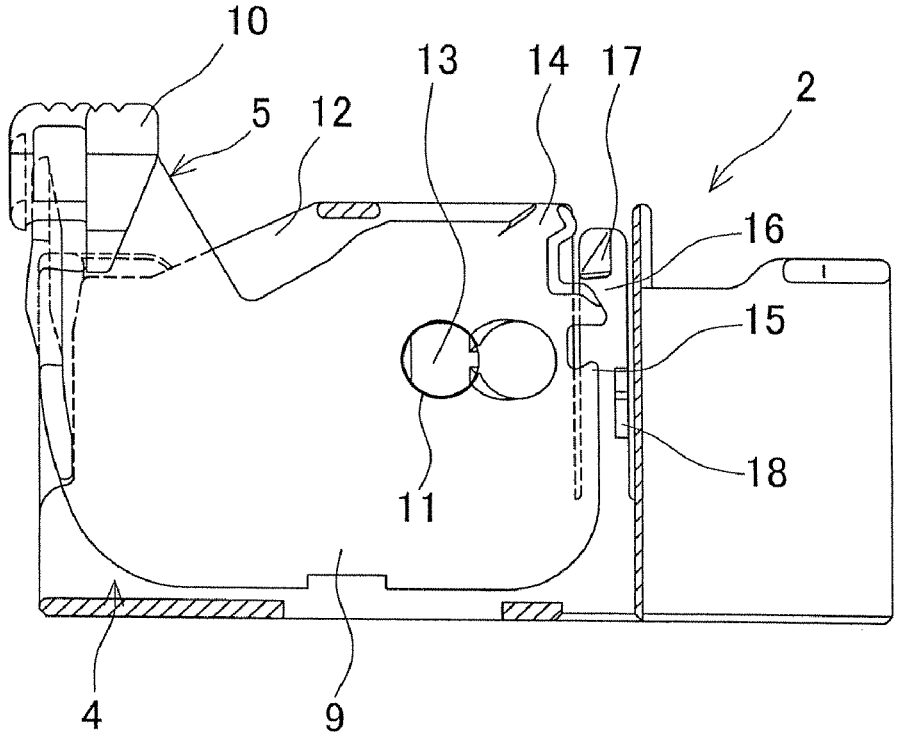

In addition, at an end portion of the partition 12 on the side of the first and second retaining portions 14 and 15, a cantilever-shaped elastic piece 16 elastically deformable to the lateral direction by means of a slit which is vertically formed from the upper end is provided. On a side surface of the elastic piece 16, which is on the side of the lever 5, a provisionally-retaining claw 17 serving as a provisionally-retaining portion is projectingly formed at the upper end. The provisionally-retaining claw 17 is on a moving locus of the first retaining portion 14 which moves from a lower position accompanying with rotation of the lever 5. As shown in FIG. 3A, when the claw 17 abuts to the first retaining portion 14, rotation of the lever 5 is restricted. At the middle portion of the elastic piece 16, which is below the provisionally-retaining claw 17, a mountain-like shape projection 18 projecting forward in a shape of triangle viewed from the front is provided. At a rotation position of the lever 5 where fitting of the connector holder 2 into the receptacle connector 3 is completed, as shown in FIG. 3B, the provisionally-retaining claw 17 is positioned between the first retaining portion 14 and the second retaining portion 15, whereby the claw 17 does not interfere with the lever 5. In addition, the mountain-like shaped projection 18 is formed on the peripheral edge of the elastic piece 16 so as not to interfere with the lever main body 9 when the lever 5 is at any rotating position.

The provisionally-retaining claw 17 has a lower surface which is inclined downward from the side of the elastic piece 16 toward the edge. In addition, as shown FIG. 4A with an enlarged view in a circle, an upper surface of the first retaining portion 14 for abutting to the provisionally-retaining claw 17 is symmetrical and mountain-like shaped in a cross-section in the thickness direction. This mountain-like portion has two inclined surfaces where one is a restricting surface 19 that substantially corresponds to the inclined surface of the provisionally-retaining claw 17, and the other is a guiding surface 20 that is inclined to the reverse side.

In the receiving portions 8, 8 of the receptacle connector 3, retaining ribs 21, 21 extending in the widthwise direction from elongate side surfaces 3*a* and 3*b* to insert into the receiving groove 4 of the connector holder 2 are provided. Here, each retaining rib 21 extends from the opposite side in the receiving portions 8, 8. That is, one receiving portion 8 has the retaining rib 21 extending from the side surface 3*a*, and the other receiving portion 8 has the retaining rib 21 extending from the side surface 3*b*. In order to fit to the retaining rib 21, a continuous groove 22 which extends from the bottom in a vertical direction and communicates with the receiving groove 4 is formed in the lateral side of the connector holder 2. Then, in accordance with respective retaining rib 21, the continuous groove 22 and the partition 12 are provided on the opposite side, whereby the connector holders 2 and the receiving portions 8 correspond one-to-one with each other. This is to prevent that the connector holder 2 is incorrectly fit. Moreover, at the bottom of the receptacle connector 3, a terminal inserting hole is formed. The hole is inserted by a not shown terminal corresponding to terminals of a female connector 6 held by the connector holder 2 and terminals of the layered connector 7.

The retaining rib 21 extends toward the elastic piece 16 of the connector holder 2 which receives the retaining rib 21, and on the front surface of the retaining rib 21 in the extending direction, a pressing projection 23 serving as a cancellation portion is provided. The pressing projection 23 interferes with the mountain-like shaped projection 18 when the connector holder 2 is fit, so that the elastic piece 16 is deformed in the direction away from the lever 5. Moreover, a retained portion 24 for retaining the second retaining portion 15 of the lever 5 when the lever 5 is positioned at a pushdown position is horizontally provided at a lateral surface of the retaining rib 21 on the side of the lever 5. Consequently, when the operating portion 10 is pushed down in a state that the second retaining portion 15 is held by the retained portion 24, the lever 5 rotates downward around the second retaining portion 15. Then, the connector holder 2 is pushed down via the circular projection 13, resulting that the female connector 6 and the layered connector 7 of the connector holder 2 are fit into the receptacle connector 3.

In the lever type connector 1 as configured above, before fitting the connector holder 2 into the receptacle connector 3, even when the operating portion 10 of the lever 5 is pressed to rotate the lever 5, the first retaining portion 14 abuts to the provisionally-retaining claw 17 as shown in FIG. 3A and the restricting surface 19 is held at a lower surface of the provisionally-retaining claw 17. Thus, the lever type connector 1 is in a provisionally-retaining state where further rotation of the lever 5 is restricted.

Figure 4A:
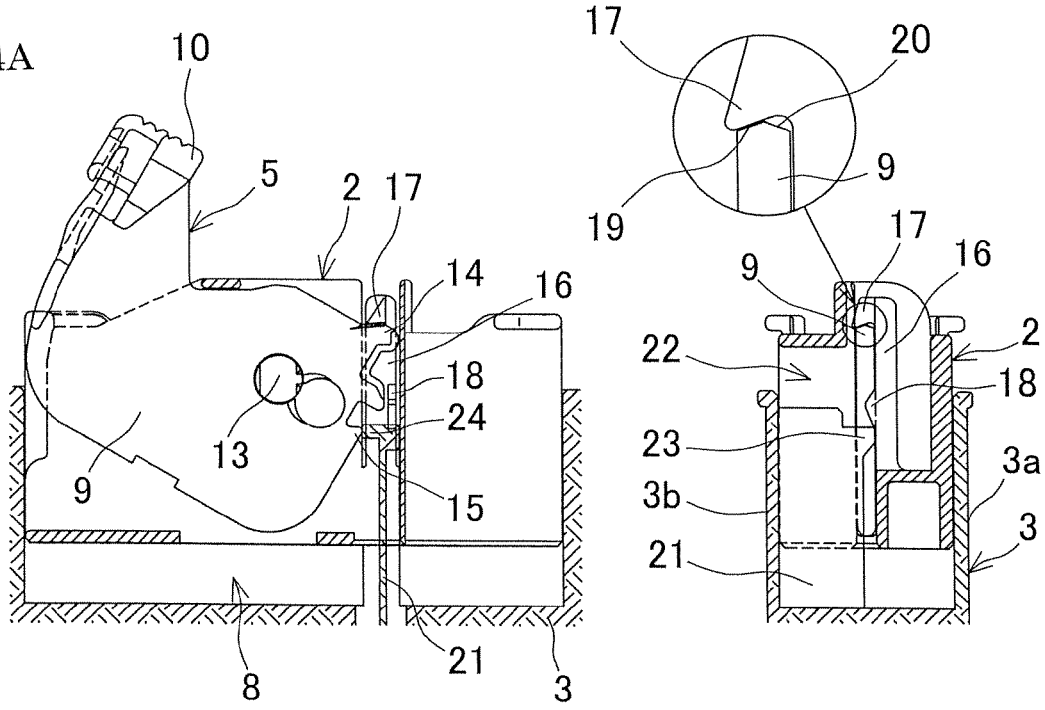
FIGS. 4A and 4B are explanation views of fitting operation of the connector holder.

In this state, the connector holder 2 is inserted from the above into the receiving portion 8 of the receptacle connector 3 as shown in FIG. 4A. At this time, the pressing projection 23 of the receptacle connector 3 is held below the mountain-like shaped projection 18 of the connector holder 2, whereby the connector holder 2 is held at the corresponding position. In this state, the second retaining portion 15 of the lever 5 is not held by the retained portion 24 of the receptacle connector 3, and the first retaining portion 14 is still held by the provisionally-retaining claw 17, so that rotation of the lever 5 cannot be performed.

Figure 4B:
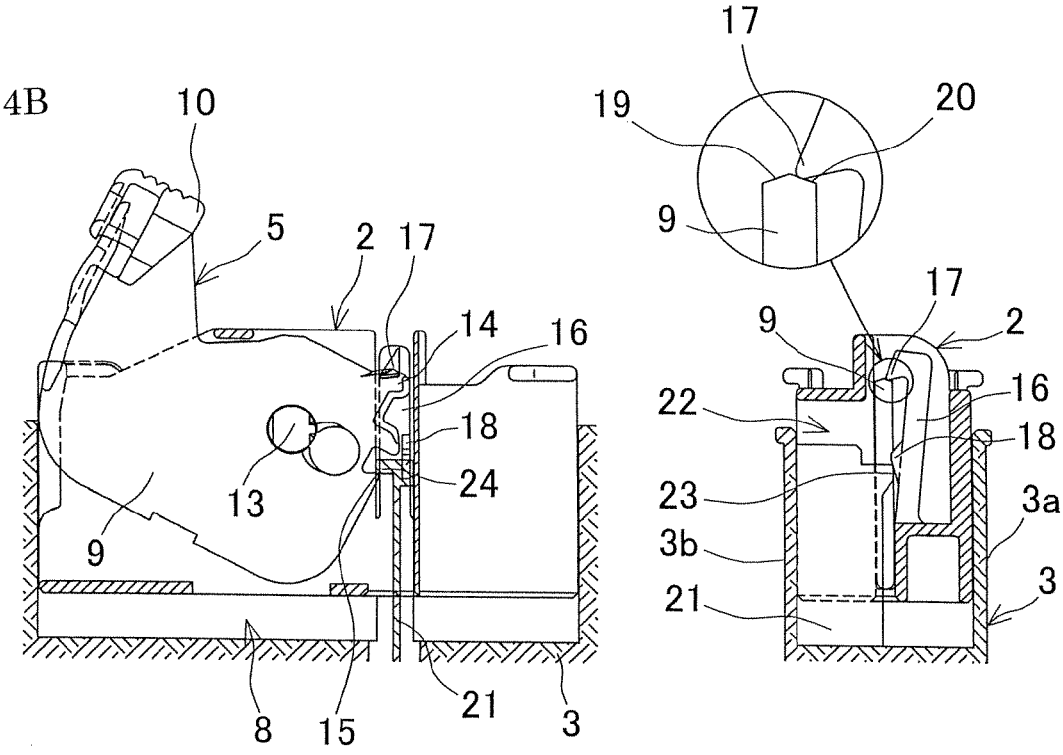

Next, when the connector holder 2 is pushed down against a condition that the pressing projection 23 is retained by the mountain-like shaped projection 18, as shown in FIG. 4B, the pressing projection 23 relatively rides over the outer surface of the mountain-like shaped projection 18, so that the elastic piece 16 is pressed to be deformed in the direction away from the lever 5. Due to this deformation of the elastic piece 16, the lower edge of the provisionally-retaining claw 17 provided at the upper end moves also away from the restricting surface 19 of the first retaining portion 14 and retracts to the side of the guiding surface 20 as shown in a view in a circle of FIG. 4B. In this pushdown position, the second retaining portion 15 of the lever 5 is below the retained portion 24 of the receptacle connector 3 to be held by the retained portion 24.

Figure 5A:
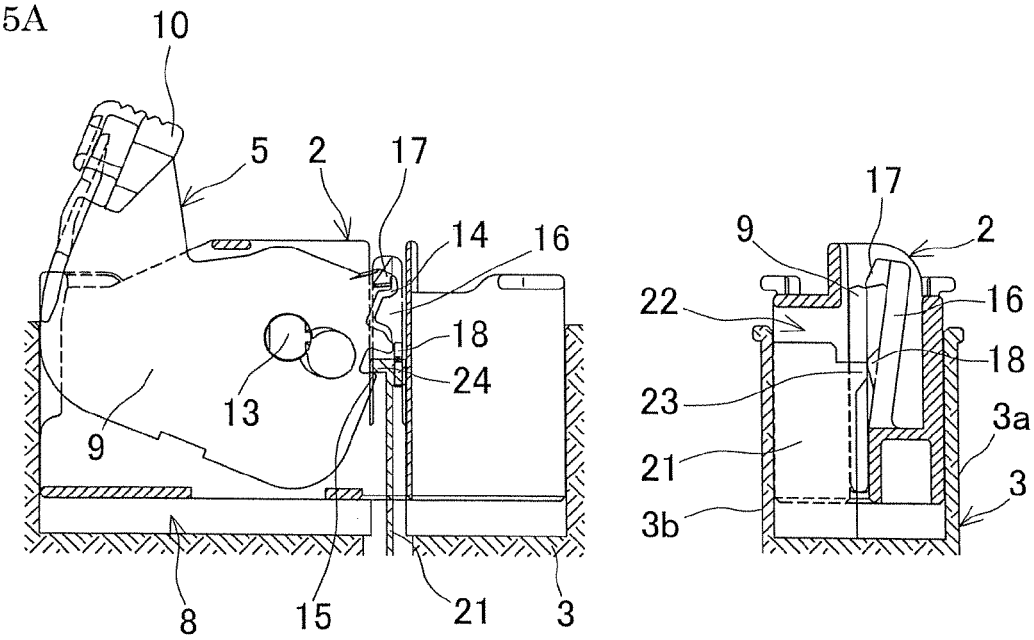
FIGS. 5A and 5B are explanation views of fitting operation of the connector holder.
Figure 5B:
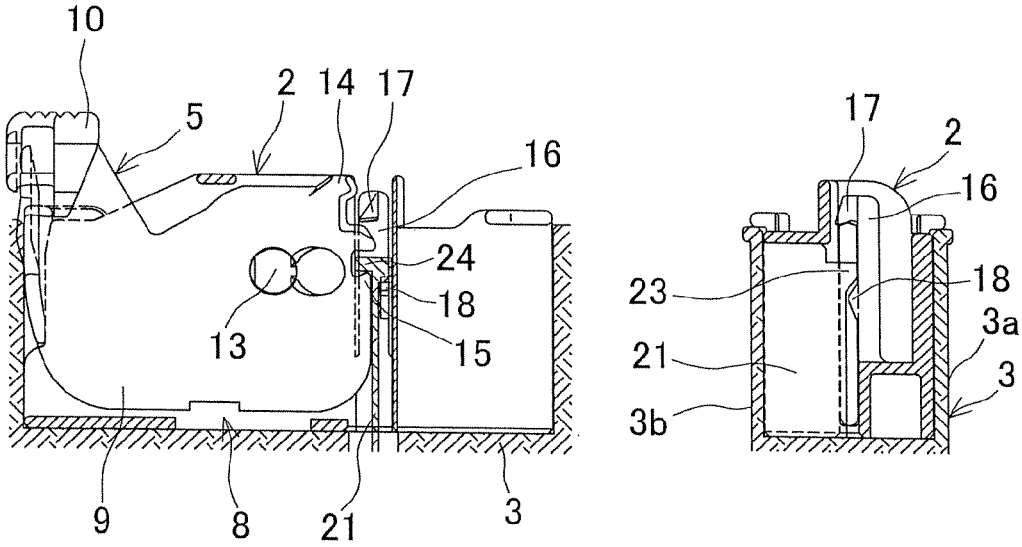

When the connector holder 2 is further pushed down, the pressing projection 23 is positioned near the top of the mountain-like shaped projection 18 to deform the elastic piece 16 to the maximum as shown in FIG. 5A. At that time, the provisionally-retaining claw 17 moves away from the guiding surface 20 of the first retaining portion 14, thereby canceling the provisional-retaining of the lever 5 (standby position). Here, when the operating portion 10 of the lever 5 is pushed down, the second retaining portion 15 is held by the retained portion 24, so that the lever 5 rotates around the second retaining portion 15 as a fulcrum. Consequently, the connector holder 2 is pushed down via the circular projection 13 as an application point, resulting that the connector holder 2 is completely fit into the receptacle connector 3 as shown FIG. 5B. In this state, the pressing projection 23 rides over the mountain-like shaped projection 18 and is positioned above the mountain-like shaped projection 18, whereby pressing to the elastic piece 16 is cancelled and the provisionally-retaining claw 17 is returned to the initial position.

On the other hand, at the pushdown position shown in FIG. 4B, the provisionally-retaining claw 17 is above the guiding surface 20 and provisionally-retaining of the lever 5 is not completely cancelled. However, when the operating portion 10 is pushed down, the abutting surface of the first retaining portion 14 pressed to the upper side. In this state, due to a slope of the guiding surface 20, the lower edge of the provisionally-retaining claw 17 is guided to be away from the lever 5 to deform the elastic piece 16. Because of this, the first retaining portion 14 is allowed to move to the upper side, and eventually the provisionally-retaining claw 17 moves away from the first retaining portion 14. Therefore, the lever 5 can be rotated. In this position, the second retaining portion 15 of the lever 5 is also held by the retained portion 24 of the receptacle connector 3. Thus, the connector holder 2 is pushed down via the circular projection 13, resulting that the connector holder 2 is fit into the receptacle connector 3.

As described above, in the lever type connector 1 of this embodiment, the abutting surface of the first retaining portion 14 of the lever 5 to abut to the provisionally-retaining claw 17 is formed to be a mountain-like shape. The mountain-like shaped surface includes the restricting surface 19 that is held by the provisionally-retaining claw 17 to restrict rotation of the lever 5 and the guiding surface 20 that forcibly moves the provisionally-retaining claw 17 to a retracted position in accordance with rotation of the lever 5. Thus, when the connector holder 2 is fit into the receptacle connector 3, because of the guiding surface 20 of the lever 5, the provisionally-retaining claw 17 is retracted forcibly to the retracted position even when the lever 5 is rotated in a state where the connector holder 2 is not reached the standby position. As a result, provisionally-retaining of the lever 5 is cancelled. Therefore, an operator rotates the lever 5 and performs the fitting without the need of confirming that the connector holder 2 is certainly pressed to the standby position, and there is no loss of operation.

Here, in the configuration where the connector holders 2, 2 and the receiving portions 8, 8 correspond one-to-one with each other by disposing the retaining rib 21 and the continuous groove 22 on the opposite side, the abutting surface of the lever 5 of the connector holder 2 has a symmetrical mountain-like shape. Therefore, the lever 5 of only one type is sufficient even when it is necessary to prepare two types of connector holder 2, and a metallic mold for the lever 5 can be used for both types of connector 2. This is advantageous in terms of cost.

In the above embodiment, the mountain-like-shaped abutting surface of the lever with respect to the provisionally-retaining portion is a straight and inclined surface. Alternatively, the mountain-like shape may be formed by a swallowed inclined surface or a curved inclined surface, or combination thereof.

Moreover, although the above explanation is made in a configuration that a pair of connector holders is fit into a pair of receptacle connectors, a configuration that one connector holder is fit into one receptacle connector may be adopted. In such a case, an abutting surface of the lever is not necessarily to be symmetrical, and the abutting surface may be asymmetrical, in which an area or an inclination angle of the restricting surface is larger than that of the guiding surface, and vice versa.

Besides, a configuration of the lever type connector is not limited to the above embodiment, for example, the number and the configuration of the female connectors and the layered connectors can be modified. Further, the lever itself is not limited to the above embodiment, for example, a pin provided with the lever main body may be inserted into the connector holder with play and may be rotatable.

What is claimed is:

1. A lever type connector comprising:

a connector holder which holds a plurality of connectors;

a receptacle connector which holds a connector corresponding to the connectors of the connector holder and into which the connector holder is fit;

a plate-like lever provided at the center of the connector holder so as to be rotatable in the upper and lower directions, wherein, when the lever is rotated in a state that the connector holder is inserted into the receptacle connector to a standby position, a fulcrum retaining portion provided eccentrically from the center of rotation is held by a retained portion provided with the receptacle connector, so that the connector holder is biased to the side of the receptacle connector;

a provisionally-retaining portion provided with the connector holder to be elastically held by the lever to restrict rotation of the lever at a predetermined rotating position before the lever is rotated in accordance with fitting of the connector holder; and a cancellation portion provided with the receptacle connector to allow the provisionally-retaining portion to be moved to a retracted position where the provisionally-retaining portion is not held by the lever in a state that the connector holder is at the standby position, so that restriction of the rotation of the lever is cancelled;

wherein an abutting surface of the lever with respect to the provisionally-retaining portion is mountain-like shaped which includes a restricting surface to be held by the provisionally-retaining portion so as to restrict rotation of the lever, and a guiding surface adjacent to the restricting surface to forcibly move the provisionally-retaining portion to the retracted position in accordance with rotation of the lever.

2. A lever type connector according to claim 1, wherein the connector holder is of an elongate box shape and made of synthetic resin.

3. A lever type connector according to claim 1, wherein a female connector having a plurality of terminal insertion portions is able to be arranged on both sides of the receiving groove of the connector holder, and a layered connector having a plurality of terminal insertion portions is able to be arranged on the front side of the lever.

4. A lever type connector according to claim 1, wherein a pair of connector holders is provided and a pair of receptacle connectors having receiving portions for the connector holders is provided, wherein each connector holder has a groove defined in the vertical direction on an outer surface thereof, and each receiving portion has a rib projecting on an inner surface thereof so as to be fit in the groove, and wherein each pair of groove and rib is provided on the opposite side so that the connector holders and the receiving portions correspond one-to-one with each other.

5. A lever type connector according to claim 4, wherein the rib includes the retained portion.

6. A lever type connector according to claim 4, wherein, in the connector holder, the mountain-like shaped abutting surface of the lever with respect to the provisionally-fitting portion is symmetrical.

7. A lever type connector according to claim 1, wherein the lever further comprises a L-shaped lever main body housed in a receiving groove defined at the center of the connector holder by a partition and an operating portion provided at an upper end of the lever main body.

8. A lever type connector according to claim 7, wherein the lever main body is coupled to a circular projection provided on a wall surface of the partition to be rotatable in an upper and lower directions.

9. A lever type connector according to claim 8, wherein, on a front edge portion of the lever main body, which is ahead of the circular projection, a first retaining portion for provisionally-retaining is provided on the upper side, and a second retaining portion serving as the fulcrum retaining portion is provided on the lower side.

10. A lever type connector according to claim 9, wherein the first retaining portion of the lever main body includes the restricting surface and the guiding surface.

11. A lever type connector according to claim 10, wherein the restricting surface and the guiding surface have straight inclined surfaces.

12. A lever type connector according to claim 7, wherein the partition includes a cantilever-shaped elastic piece capable of being elastically deformed to the lateral direction, and the provisionally-retaining portion is a provisionally-retaining claw provided on an upper end of the elastic piece.

13. A lever type connector according to claim 12, the provisionally-retaining claw has a lower surface which is inclined downward from the side of the elastic piece toward an edge portion.

14. A lever type connector according to claim 12, wherein the elastic piece includes a mountain-like shape projection projecting to the lateral direction in a shape of triangle below the provisionally-retaining claw.

15. A lever type connector according to claim 14, wherein the cancellation portion is a pressing projection which interferes with the mountain-like shaped projection when the connector holder is fit, so that the elastic piece is deformed in a direction away form the lever.

* * * * *